US007137900B1

(12) United States Patent
Van Dyke

(10) Patent No.: US 7,137,900 B1
(45) Date of Patent: Nov. 21, 2006

(54) APPARATUS AND METHOD FOR PRACTICING GOLF BALL PUTTING

(76) Inventor: Peter F. Van Dyke, 13011 82nd Ct., Palos Park, IL (US) 60464

( * ) Notice: Subject to any disclaimer, the term of this patent is extended or adjusted under 35 U.S.C. 154(b) by 0 days.

(21) Appl. No.: 11/144,563

(22) Filed: Jun. 3, 2005

(51) Int. Cl.
*A63B 69/36* (2006.01)

(52) U.S. Cl. ..... 473/157; 473/162

(58) Field of Classification Search ..... 473/150–196
See application file for complete search history.

(56) References Cited

U.S. PATENT DOCUMENTS

| | | | | |
|---|---|---|---|---|
| 1,952,187 | A | 3/1934 | Wade | |
| 2,057,504 | A | 10/1936 | Schafer | |
| 3,184,239 | A | 5/1965 | Heuser | |
| 3,584,877 | A | 6/1971 | Florian | |
| 3,862,760 | A * | 1/1975 | Davis | 473/159 |
| 3,944,232 | A * | 3/1976 | Tierney | 473/162 |
| 4,017,084 | A * | 4/1977 | Jeffery | 473/162 |
| 4,108,440 | A * | 8/1978 | Delaplaine | 473/160 |
| 4,215,865 | A | 8/1980 | Pilati | |
| 4,877,250 | A | 10/1989 | Centafanti | |
| 4,988,106 | A | 1/1991 | Coonrod | |
| 5,108,101 | A | 4/1992 | Postula | |
| 5,261,670 | A * | 11/1993 | Mull | 473/182 |
| 5,390,926 | A | 2/1995 | Hanson et al. | |
| 5,628,694 | A | 5/1997 | O'Connor, Jr. | |
| 5,630,719 | A * | 5/1997 | Franklin | 434/252 |
| 5,720,667 | A | 2/1998 | Tu | |
| 5,860,648 | A | 1/1999 | Petermeier et al. | |
| 6,001,033 | A | 12/1999 | Tucker | |
| 6,056,645 | A | 5/2000 | Servatius | |
| 6,398,662 | B1 * | 6/2002 | Cox | 473/192 |
| 2003/0096658 | A1 * | 5/2003 | Elliott | 473/162 |

* cited by examiner

*Primary Examiner*—Mark S. Graham
(74) *Attorney, Agent, or Firm*—Banner & Witcoff, Ltd.

(57) ABSTRACT

A carpet putting surface having a longitudinal length longer than its lateral width and comprising a predetermined putting location marking, and a plurality of substantially "V" shaped markings placed apart from the predetermined putting location marking, with each substantially "V" shaped marking having the open end of the "V" closer to the predetermined putting location marking than the closed end of the "V." An apparatus for practicing golf ball putting comprising a carriage having a spool of carpet putting surface and a golf ball retriever is also disclosed and adapted for use on a bowling alley lane.

24 Claims, 5 Drawing Sheets

APPARATUS AND METHOD FOR PRACTICING GOLF BALL PUTTING

FIELD OF THE INVENTION

The present invention relates to an apparatus and method for practicing golf ball putting, including but not limited to, an apparatus and method for practicing golf ball putting on a bowling alley lane.

BACKGROUND OF THE INVENTION

Golf is played by millions of Americans each year. There are more than 16,000 golf courses in the United States. Millions of people also enjoy bowling by rolling bowling balls down gleaming wooden lanes each year. Both sports have top performance professionals and societies that issue specific rules, standards for equipment, and foster competition for playing the game. Each sport also has participants who simply enjoy recreation provided by the sport, as well as modifications of the sport, such as playing golf or bowling at arcades, miniature golf or miniature bowling. Players thus range in grade from more serious players to recreational players in both sports.

Beginners in these sports are coached and/or learn from trial and error. Learning fundamentals and attempting perfection leads to a range of frustration to a sense of accomplishment. Experience and skills are sometimes developed to the point that results in the "ranking" of the player. Associations have been formed to monitor and promote these sports. The best players may be seen on television playing in competition.

Half of golf strokes are on the greens. Usually courses require 2 putts per green for 18 holes. Putting typically involves a relatively gentle tap to roll the golf ball. Successful putting to minimize the number of putting strokes to sink the ball in the golf hole requires extreme effort of concentration and skill. Skills develop by practice. Four elements in putting concern addressing the ball, developing consistent stroke, learning aim, and applying the correct amount of tap or putt to the ball to achieve desired movement and stoppage of the putted golf ball. Practice putting greens at golf courses are not sufficiently fitting for repetitive practice needed for learning or for sharpened honing of successful putting technique to be applied on greens on a golf course. For example, practice putting greens do not provide for mechanized retrieval of putted balls. Practice putting greens rarely provide a range distance references so a person practicing putts knows how exactly how far the putt will be to the practice hole. Practice greens have drainage slope and irregular surface undulations. In addition, practice putting greens are limited in that they are only available for use when weather is permitting.

Conventional apparatus include portable or permanent practice putting surfaces. See e.g., the U.S. Pat. No. 6,056,645 (Servatisus), U.S. Pat. No. 5,655,971 (Wayne), U.S. Pat. No. 5,441,265 (Codlin), U.S. Pat. No. 3,892,412 (Koo), and U.S. Pat. No. 3,690,673 (Occhipinti). For other conventional apparatus for practice putting, see U.S. Pat. No. 5,720,667 (Wan-Chu Tu), U.S. Pat. No. 5,108,101 (Postula), U.S. Pat. No. 4,877,250 (Centafanti), U.S. Pat. No. 2,057,504 (Schafer), U.S. Pat. No. 1,952,187 (Wade), U.S. Pat. No. 4,215,865 (Pilati), U.S. Pat. No. 3,184,239 (Heuser), U.S. Pat. No. 4,988,106 (Coonrod), U.S. Pat. No. 5,390,926 (Hanson), U.S. Pat. No. 6,001,033 (Tucker), U.S. Pat. No. 5,860,648 (Petermeier). Despite the benefits provided by these conventional practice putting surfaces and apparatus, there is still a need for improved putting surfaces and apparatus.

BRIEF SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

The invention is an apparatus and method for practicing golf ball putting. The invention can also be used to "tryout" a new putter and/or golf ball.

In one aspect of the invention, a carpet putting surface is rolled from a spool onto a flat horizontal surface, including for example, but not by way of limitation, the lane of a bowling alley. The carpet putting surface can be rolled back onto the spool, e.g., when it is desired for a bowling alley lane to be used for bowling. As an alternative to use in a bowling alley, the carpet putting surface of the present invention can be used in another suitable area, including but not limited to a golf shop, a recreation center, a golfing emporium or golf club, or near a golf course or driving range.

In a preferred embodiment, the carpet putting surface has approximately the same Stimp meter (as approved by the United States Golf Association) measurement number as a typical golf course green. The carpet putting surface identifies a plurality of discrete areas or "holes," with each "hole" being a certain distance from a line where the user putts in front of. Each hole can be identified by any suitable means, such as one-sided adhesive tape in substantially in the shape of a "V" with the open part of the "V" being closest to the person putting, and the closed part of the "V" being furthest from the person putting. The carpet putting surface can also have lines or regions (identified e.g., with one-sided adhesive tape) that will enable a user to determine approximately how close the ball to be putted is to the targeted hole. The user can putt first to the farthest "hole", then the next farthest "hole", etc., until the user has putted to each "hole."

A game can be played by keeping track how close each putted ball is to each respective target hole. For example, if a putted ball stops inside the hole or "V," then it can be considered that the user has "one-putted" that hole. If the putted ball stops outside of the hole or "V," but is twenty-four inches or less from the hole or "V," then it can be considered that the user has "two-putted the hole," etc.

In another aspect of the invention, a golf ball retriever is provided to move towards the user and retrieve the putted balls. The golf ball retriever can also be a back-stop to prevent putted balls from venturing past or off of the far end of the carpet, such as into a bowling pin area when the carpet is rolled onto a bowling alley lane.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE PREFERRED EMBODIMENTS

Figures 1, 2:
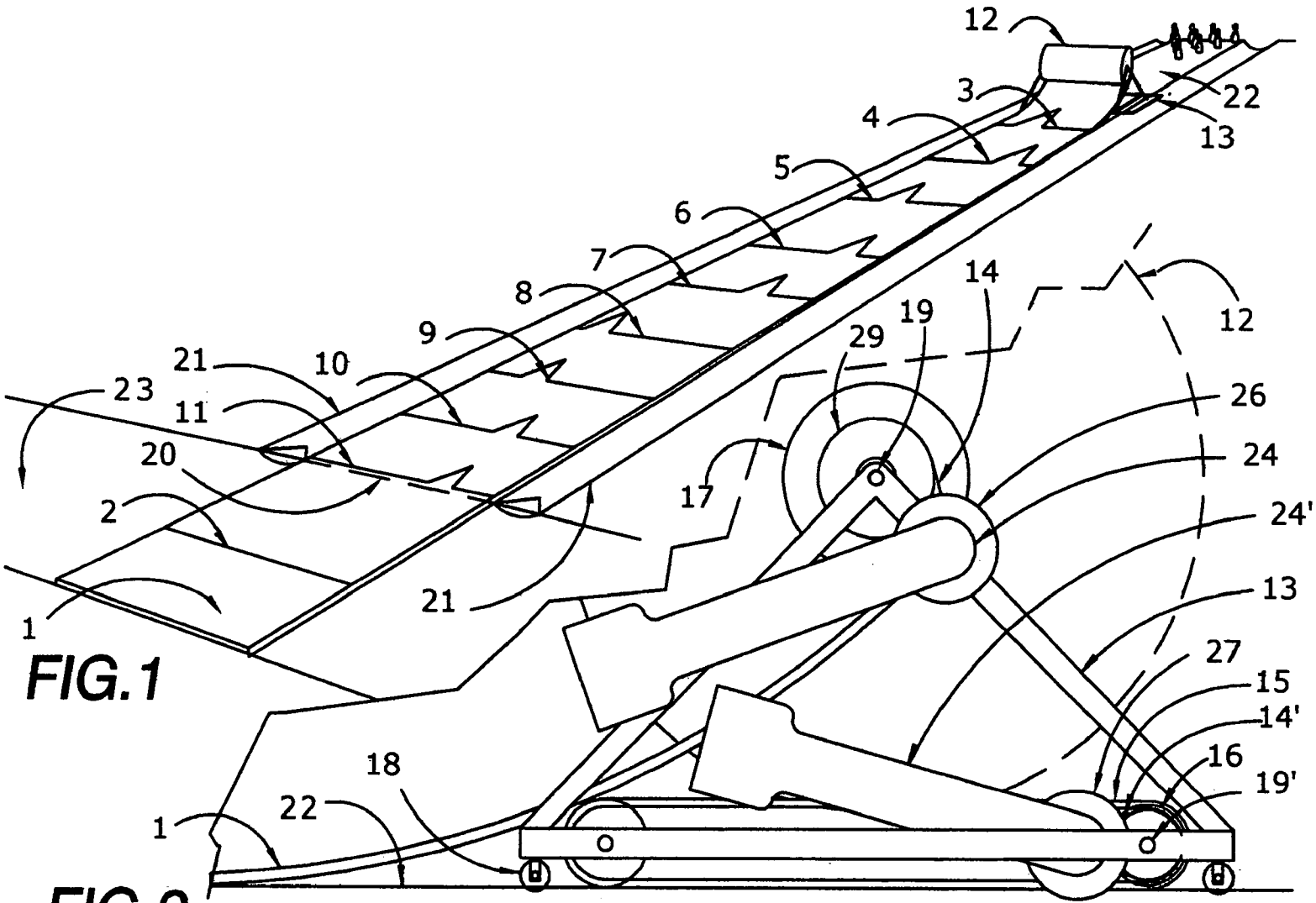
FIG. 1 is a perspective view that illustrates an embodiment of the present invention wherein a carpet putting surface has been laid out onto bowling alley lane.
FIG. 2 is a side elevation view that illustrates a carriage in accordance with an embodiment of the present invention.

The present invention provides an apparatus that can be used in readily available controlled conditions. The apparatus can be used indoors any time of the day, and avoid any adverse outdoor conditions, such as cold temperatures, rain, snow, wind, bright sun, and darkness. In a preferred embodiment, the apparatus of the present invention is used on any suitable surface, such as a flat and horizontally level bowling alley lane surface.

In one aspect of the invention, a carpet putting surface is rolled from a spool onto a flat horizontal surface, including by for example but not by way of limitation, the lane of a bowling alley. As an alternative to use in a bowling alley, the carpet putting surface of the present invention can be used in another suitable area, including but not limited to a golf shop, a golfing emporium or golf club, or near a golf course or driving range.

In a preferred embodiment, the carpet putting surface has approximately the same Stimp meter (as approved by the United States Golf Association) measurement number as a typical golf course green, e.g., a 10 Stimp meter reading, which is approximately equals golf green quality that Professional Golf Association players play on. A standard bowling alley lane typically has about 16 feet of approach and 60 feet from the foul line to the head bowling pin.

In a preferred embodiment, the carpet putting surface is laid out starting at the bowling lane approach, and rolled down the lane from a spool on a carriage. Preferably, the carriage is powered by a motor. In a preferred embodiment, the carpet putting surface extends a length of about 55 feet length for lagging putts, plus ample standing room for the player putting. Bowling pins can remain standing because carriage stops short of the pins.

The present invention provides indoor putting practice for flat, level, and long or short, putting on preferably high premium synthetic carpet. These ideal conditions for learning and practice can be offered around the bowling clock, every day, any time, rain or shine. This invention is organized in a relatively short period of time—about less than 1 minute for un-spooling of the carpet putting surface onto bowling alley lane by motorized remote controlled carriage. The carriage travels a satisfactory distance and then stops short of the standing bowling pins.

When it is desired to convert the golf ball practice putting area back to bowling alley lane ready for bowling, the carriage is powered back towards the approach area, thereby rolling the carpet putting surface back onto the spool. When powered by a motor, this operation takes about less than 2 minutes.

In a preferred embodiment, the carpet putting surface has nine marked distances generally at five feet intervals and includes generally "V" shaped targets, with the open end of the each "V" facing the person putting, and the opposite end of the "V" signifying a golf hole. Natural golf greens feature the challenge of undulations, tilt, slope, as well as grass that may have been walked upon, or is soaked, scorched, and/or repaired. However, in the present invention, the carpet putting surface provides ideal conditions for putting. These ideal conditions promote learning skills and development of correct form by repetition independent of uneven golf green settings. Skills may include stance, address, grip, aim, rhythm, leading to swing back, swing forward, finish and follow-through of putting stroke. The practicality of conversion of a bowling alley lane for putting makes use of idle bowling alley lanes. Possible putting times may include when bowling alley lanes are not typically used, such as early morning, late night, time when there is an absence of league bowling, or slack summer season. Perfect conditions promote tryout of new putting clubs, golf balls, and putting aids. Putting lessons on premium carpet in complete modern bowling facilities are possible because of the apparatus provided by the present invention.

In another aspect of the invention, an electric-powered rapid traverse golf ball retriever is also provided. This retriever is positioned towards the end of the laid down carpet putting surface opposite the end of the where the person will be putting from. The retriever acts as a back-stop as well as a ball retriever. When the carpet putting surface is laid down, the retriever is positioned near the end of the carpet putting surface opposite the end where the person is putting from. In the instance when the carpet putting surface is laid along a bowling alley lane, the retriever is positioned towards the opposite end of the foul line, and after the farthest "hole" identified on the carpet putting surface. In this bowling alley application, the retriever acts as a back-stop, as well as preventing putted balls from becoming lost in the bowling pin pit or remain in the bowling alley gutters. In this embodiment, the retriever rides in the bowling alley gutters without touching the carpet putting surface, and returns all putted balls back to the foul line when the person putting has finished a practice putting round. The retriever can be operated remotely from the approach area. Preferably, the retriever has less than 1 minute motorized traverse movement.

The person putting simply takes returned balls that have been retrieved by the pick-up wheels of the retriever from an elevated retriever container. No bend down is required to pick up balls from the carpet or gutters.

Preferably, the carriage and the retriever are each moveable on swivel casters for either motorized movement, or manual movement. Thus, the carriage and the retriever can move back and forth towards the putting area as may be desired, and both apparatus can be stored as well when not in use.

The carpet putting surface apparatus provides a relatively short changeover time from bowling to putting and back again.

FIG. 1 is a perspective view of a carpet putting surface 1 laid from spool of carpet 12 onto bowling alley lane 22. Preferably, carpet putting surface as a width of 41 inches. Bowling alley lane 22 has two gutters 21, foul line 20, and approach area 23. Markings are made on the carpet putting surface using any suitable material, such as white cloth adhesive tape 1" wide and 0.007" thick. "V" shaped targets are located at nine marker distances 3 through 11 having five-foot intervals. A user can drop a ball around marker 2 in a 6-foot long zone and putt to any of the five-foot incremental distances identified by markers 3 through 11. A user can lag putt to marker 3, which is 50 feet away from marker 2. Marker 3 length is carpet width 41", which presents a target of acute angle of 3.19 degrees. A putted ball exceeding this angle will fall off the carpet into a gutter. As shown in FIG. 1, the shortest putting distance is around 10 feet to marker 11 in the embodiment shown. Some of carpet putting surface 1 remains attached to carriage spool 17. Spool of carpet 12 is supported by carriage 13, shown near standing bowling pins (not numbered).

Figure 3:
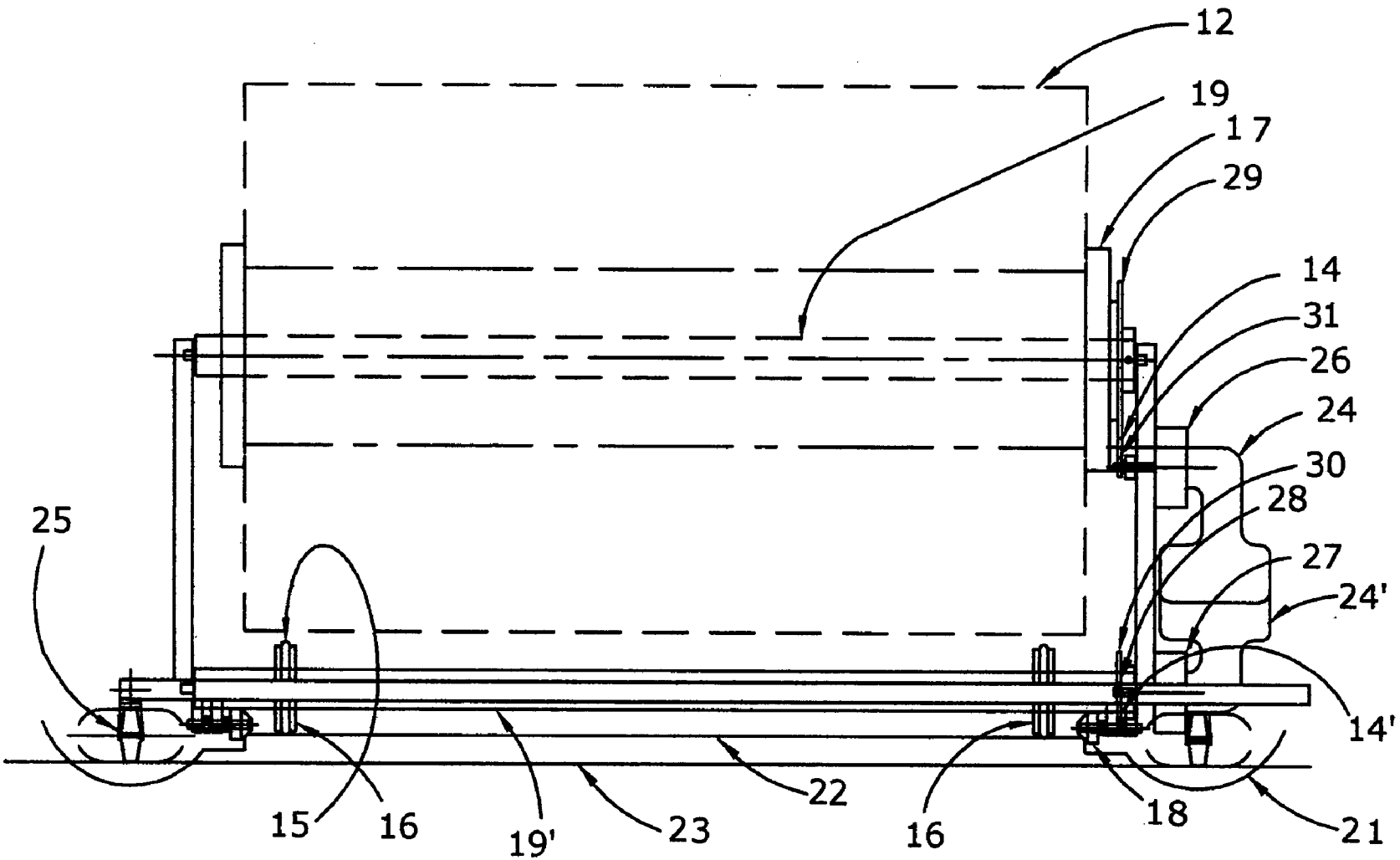
FIG. 3 is a front elevation view that illustrates the carriage shown in FIG. 2.

FIG. 2 is a side elevation of carriage 13 with full extent, dashed line. FIG. 3 is a front elevation view that illustrates the carriage shown in FIG. 2. A spool of carpet 12 is wound around carriage spool 17. As shown in FIGS. 2 and 3, carpet putting surface 1 drapes onto bowling alley lane 22. Spool axle 19 and two pulley axles 19' are provided, and are substantially the same. Preferably, spool axle 19 has a separate electric motor drive 24 with clutch 26, roller chain 14, and driven sprocket 29 to rewind carpet onto carriage spool 17. One of the pulley axles 19' has a separate motor drive 24' with clutch 27, roller chain 14' and driven roller chain sprocket 30 (see FIG. 3) to propel carriage 13 to lay carpet. Roller chains 14 and 14' and their corresponding sprockets are used preferably at speed-reduced ratios. Carriage 13 has four edge guide rollers 18, two on each side edge of the bowling lane 22 as shown, and each guide roller is adjustable in spring loaded contact force, and provides guiding in opposite carriage travel directions. The weight of carriage 13 is supported by four pulley wheels 16, two secured onto each common pulley axle 19' to rotate in unison. Pulley wheels 16 ride on polyurethane cord belts 15 supported by contacting lane surface 22. Preferably, belting is of equal length and pre-tensioned about 4% of free length. Clutch 27 engages to drive carriage 13 only to lay carpet 1 onto bowling alley lane 22, while clutch 26 free-wheels. Clutch 26 engages to drive only to rewind carpet 1 onto carriage spool 17, while clutch 27 free-wheels. Tension in carpet from powered re-spooling causes carriage to be pulled back along lane to foul line in preparation for storage.

As shown in FIG. 3, carriage 13 has swivel casters 25 (four total), generally at corners of carriage 13, which overhang gutters 21. Swivel casters 25 can be used for moving carriage 13 to or from storage. At the time of laying carpet putting surface 1 onto lane 22, swivel casters 25 enter gutter 21 via an inclined ramp lead-in feature of the bowling gutter so that edge guide rollers 18 engage bowling lane 22 edges and two polyurethane cord belts 15 make contact with bowling lane 22. Swivel casters 25 hang unused directly over gutters 21, which carriage 13 traverses bowling alley lane 22. Carriage drive clutch 27 has output sprocket 28, roller chain 14', and driven roller chain sprocket 30 attached to pulley axle 19'. Spool drive clutch 26 has output sprocket 31, roller chain 14, and driven roller chain sprocket 29, which is attached to spool axle 19 near one end and to spool 17. Two separate electric motor drives 16 provide power to either clutch separately on demand. FIG. 3 shows spool of carpet 12 as dashed outline.

Figure 4:
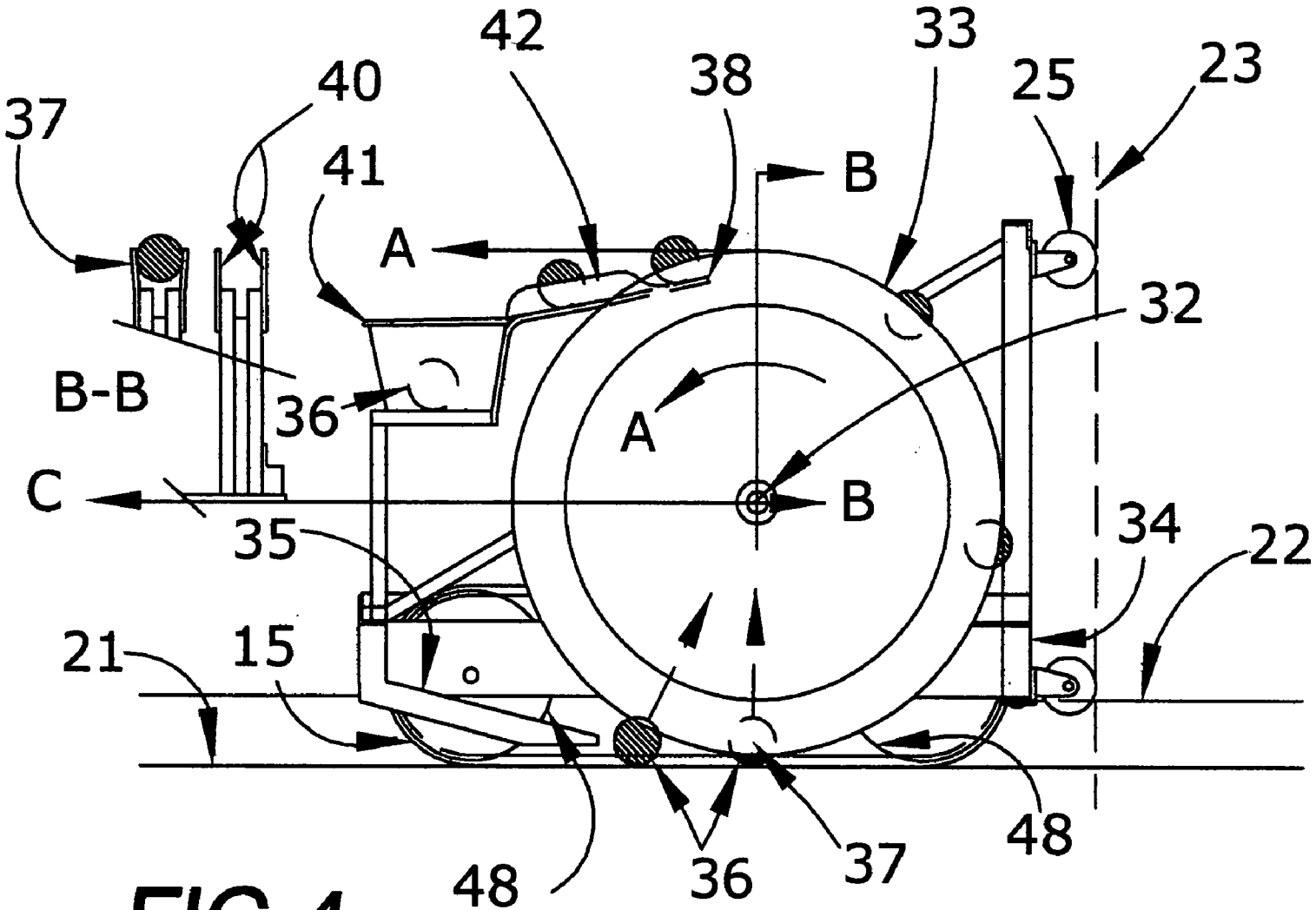
FIG. 4 is a side elevation view of an embodiment of a ball retriever in accordance with the present invention.

FIG. 4 is a side elevation of golf ball retriever 34 positioned so as to ride in gutter 21 on polyurethane cord belt 15 around two pulley wheels 48. Retriever 34 straddles bowling alley lane 22 surface from gutter to gutter. A golf ball 36 is shown in gutter 21 and at various random gripped places, each having been captured by pickup wheel 33. Each gutter 21 has one pickup wheel 33 attached to each axle shaft 32, and pickup wheels 33 and axle shafts 32 are shown to revolve in direction of the arrow designated "A". Pickup wheel 33 is spaced away from and does not touch gutter 21. Retriever 34 moves horizontally in direction of the arrow designated "C," while revolving pickup wheels 33 capture golf balls 36 gleaned from gutters 21. The traverse speed of retriever 34 is organized to essentially match the peripheral speed of pickup wheel 33, causing a golf ball 36 to enter into friction gripping surfaces in the direction of arrows shown pointing toward axle shaft 32 eliminating scrubbing of ball on gutter surface. FIG. 4 shows fully gripped golf ball 36 in gutter 21 at position 37. Elevated finger 38 causes golf balls 36 to be removed from the gripping surfaces of pickup wheel 33. Section B—B shows parallel elastomeric opposing faces 40 and also friction gripped position 37. FIG. 4 shows herding means 35 for directing golf balls 36 into wheels 33 and further functions to prevent balls from passing by retriever 34 and entering a bowling pin pit. A guiding channel 42 and a catching pan 41 correspond to each gutter 21 to collect and present lifted golf balls 36 back to a user. When not in use and with golf balls removed, storage of retriever 34 is made simply by tipping so that the weight is distributed onto the four swivel casters 25, at 90 degrees onto dashed line approach area 23.

Figure 5:
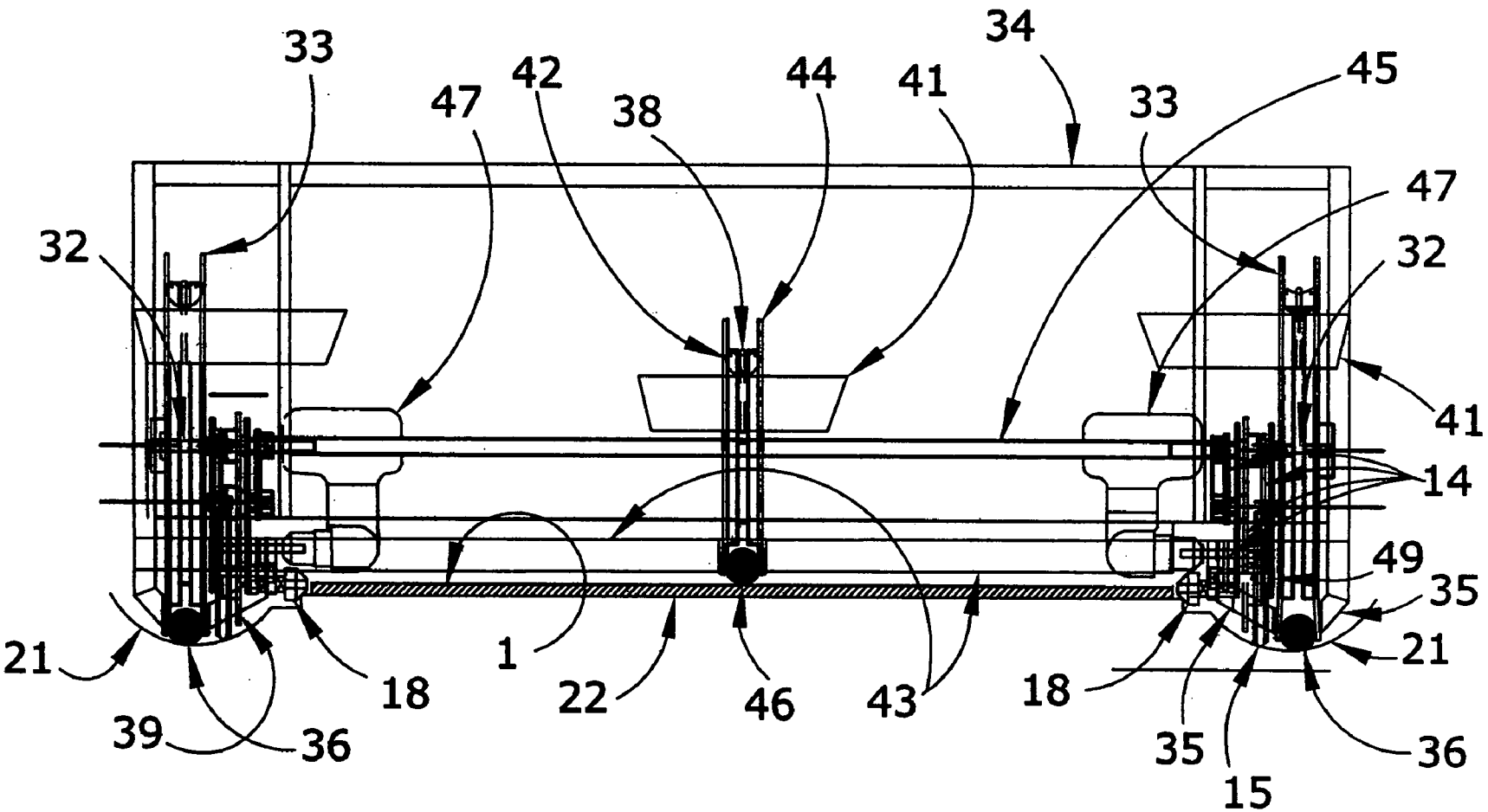
FIG. 5 is a front elevation view of the ball retriever shown in FIG. 4.

FIG. 5 is a front elevation of retriever 34 straddling bowling lane 22 covered with carpet putting surface 1. Pickup wheel 44 is designed for pickup of golf balls that stay on the carpet putting surface 1, as opposed to golf balls that fall into gutters 21. Pickup wheel 44 is centered over the width of carpet putting surface 1. Pickup wheel 44 is attached to axle 45 coaxially supported at each end by axle 32. FIG. 5 shows a golf ball 36 on carpet putting surface 1 at entry position 46. Herder bars 43 acts as funnels to align golf balls to entry position 46 for gripping by pickup wheel 44 as retriever 34 traverses toward the bowling foul line 20. Pickup wheel 44 does not touch the carpet putting surface. Also shown are bowling lane edge guide rollers 18, four total, two on each side with one in front and one in back on each side of the retriever 34. Edge guide rollers act to guide retriever 34 during its movement along the bowling lane 22 traverse in either direction. Golf ball collection pan 41, channel guide 42, and finger 38 are provided for removal of golf balls 36 from pickup wheel 44, similar to those provided for removal of golf balls 36 from gutters 21. FIG. 5 shows extra duty capacity incorporated as dual electric drive motors 47, each featuring reversible rotation direction.

Figure 6:
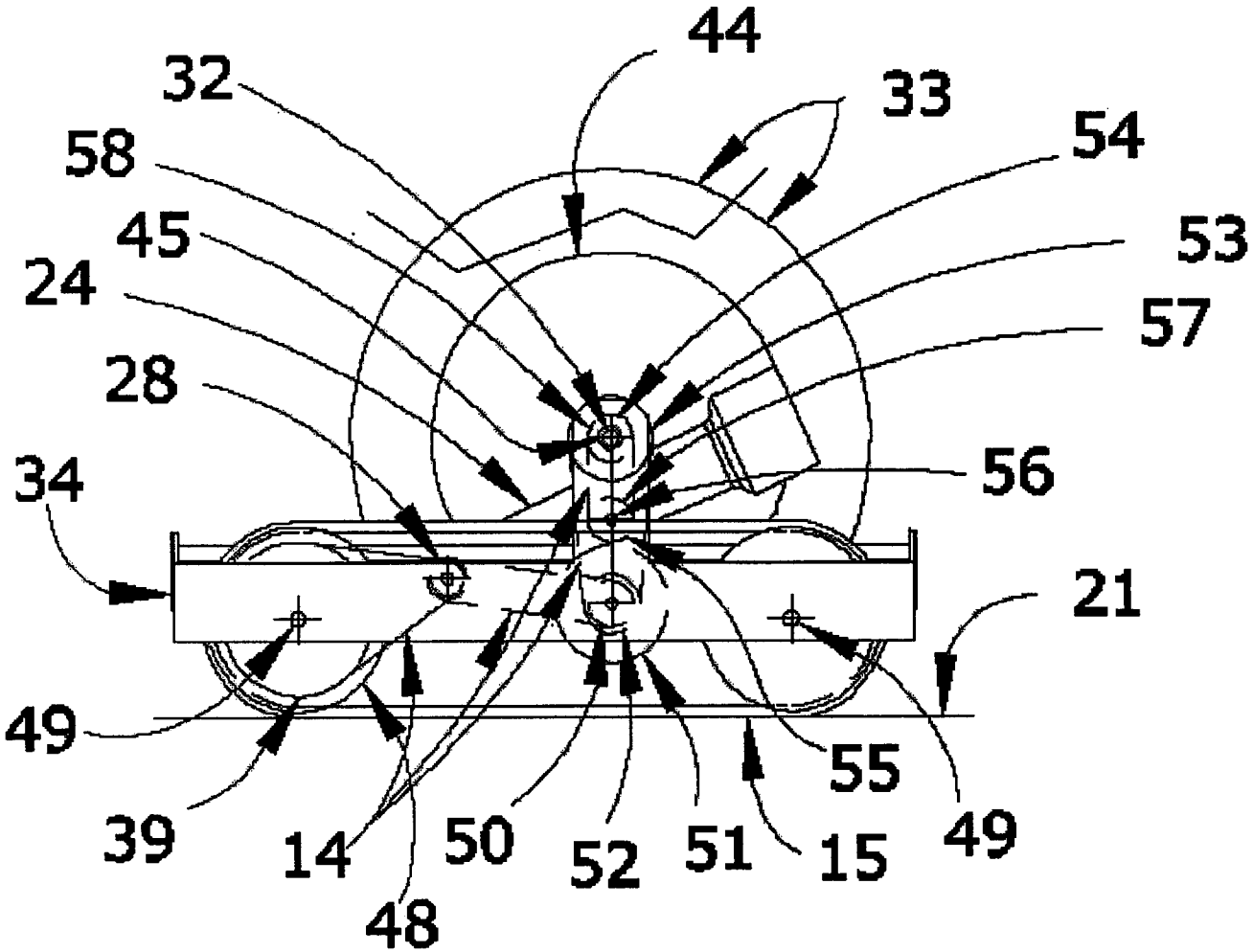
FIG. 6 is partial side elevation of the ball retriever shown in FIG. 4.

FIG. 6 is partial side elevation of retriever 34, and shows a drive system having roller chain 14 and sprockets, 28, 39, 50, 52, 53, 54, 55, 57, and 58. Each electric drive motor 47 (shown in FIG. 5) is operatively connected to output sprocket 28, which drives each roller chain sprocket 39, secured to a grooved pulley wheel 48 that can rotate about each stub shaft 49 for powering retriever 34 for bowling alley traverse. Each electric drive motor 47 has a second drive output sprocket 28 to drive each roller chain sprocket 50 for power input into each clutch 51. Each clutch 51 has output sprocket 52 driving roller chain sprocket 53 attached to each axle 32 driving each attached pickup wheel 33. Each axle 32 also has another attached sprocket 54 driving roller chain sprocket 55 attached to each stub axle 56. Also attached to stub axle 56 is sprocket 57, which powers sprocket 58, which is attached to opposite ends of common shaft 45. As shown in FIG. 5, shaft 45 is operatively connected to pickup wheel 44. Sprocket ratios are used preferably at speed-reduced ratios and provide for substantially equal peripheral speed for pickup wheels 33 and 44, which have different diameters. Sprocket ratios are also preferably used to provide substantially matched traverse speed to peripheral wheel speed. Identical clutches 51 feature adjustable clockwise or counter-clockwise setting to enable drive actuation, or free wheeling of output sprocket 52 to provide for powered pickup wheel rotation in one direction only. Thus, pick up wheels 33 and 44 rotate only when picking up putted golf balls, but do not rotate for traverse return.

In accordance with an aspect of the invention, a carriage is provided to support a spool of wound-on high quality putting carpet. The carriage rolls on swivel casters to the foul line of the bowling alley lane for manual off-spool of carpet onto the approach area. Then casters enter gutters at the foul line and they are no longer used when drive roll belting makes contact with the lane surface near the lane edges and spring-loaded guide rolls engage the alley edges for guiding. The electric carriage drive is then activated for about 40 seconds to propel the carriage and lay about 50 feet of carpet. The carriage stops with some remaining carpet attached to spool to wait for the end of the putting session, after which carpet is re-spooled in about 40 seconds for storage. The unique carriage drive employs two round cross section food grade clear polyurethane pre-tensioned cord drive belts riding in round bottom groves of pulley wheels. The round section cord acts as toothless transmission belting, but is considerably less expensive as compared to toothed sprockets. This embodiment provides for unidirectional centrifugal clutches used in carriage drive and in spool drive. Carriage drive clutch only drives the carriage away from the foul line to lay carpet. Clutch 27 free-wheels when the carpet is re-spooled. The spool drive clutch 26 only drives to re-spool carpet, which causes the carriage to be pulled by tension in carpet back to the foul line, wherein carriage drive clutch 27 free-wheels. In about the 40 seconds it takes to complete re-spooling the carpet, the carpet is in slight tension causing desired uniform spooling and compact roll for storage. Separate drive motors can be operated by remote control known to those of skill in the art for both propelling the carriage and for re-spooling carpet as desired.

Preferably, variable speed electric motors are used which have a maximum of about 1500 RPM and about a 3 to 1 reduction to a preferred 500 RPM driving sprockets using standard roller chain. Remote control allows the person putting to operate the carriage from the bowling approach area.

In accordance with another aspect, the invention provides a remote controlled retriever for ball return. Initially this device is sent down the carpeted lane to wait near the carriage for putting session completion. When a person finishes putting, the person can use the remote control to activate the retriever to return all the putted balls from carpet or from gutters back to the foul line. In about 40 seconds, the retriever traverses toward the foul line with all the putted balls lifted into separate carpet and gutter containers, suitably elevated for ease of removal by person putting. On command, the retriever is sent back down the lane to the wait position, so more balls can be putted. Motors, clutches, sprockets, roller chain, alley edge guides, round groove pulleys, swivel casters, and round cord belting are similar to those used in carriage. The unique pick-up of balls is accomplished by three separate rubber faced wheels attached to horizontal shafting. Each gutter has one pick-up wheel and the third pick-up wheel is central to the carpeted lane. Preferably, no part of the lane straddling retriever touches the carpet. The pick-up wheels of the retriever rotate in unison when picking up golf balls so that the retriever traverse speed equals pick up wheel peripheral speed. Centrifugal clutch 51 free-wheels on the return traverse so pick up wheels do not rotate. The balls to be picked up that are resting on the carpet putting surface are herded into central pickup wheel by funneling herder bars. The herder bars or arms are also used in gutters prevent any putted balls from passing by retriever and getting into bowling pin pit. Rubber parallel faces of pick-up wheels are spaced apart for a distance less than ball diameter, so as to pinch or grip ball wedged in between resilient faces. Rubber elasticity frictionally captures ball, which then rotates with the wheel until removed by finger near the upper most wheel elevation above carpet or gutter. Fingers have a slightly sloped channel portion to guide ball freed from between rubber faces into adjoining container. The weight of the retriever 34 rests equally on four contacting points of round cord belting and is carried by bowling gutters, in which retriever traverses.

In accordance with an aspect of the invention, a carriage is provided to support a spool of wound-on high quality putting carpet. The carriage rolls down to the foul line of the bowling alley lane for manual off-spool of carpet onto the approach area. When the casters enter the gutters at the foul line, they are no longer in contact with any surface of the lane or alley, and the drive roll belting makes contact with the lane surface near the lane edges and spring-loaded guide rolls engage the alley edges. The electric carriage drive is then activated for 40 seconds to propel the carriage and lay about 50 feet of carpet. The carpet stops with some remaining carpet attached to wait for the end of a putting session before re-spooling and storage. The unique carriage drive employs two round cross section food grade clear polyurethane cord drive belts riding in round bottom grooved pulleys. The pulleys are mounted on two fixed spaced parallel horizontal shafts using suitable support bearings. Each shaft has two pulleys. Two round cord drive belts stretch from shaft to shaft wound around the pulleys. The carriage load is equally distributed onto four pulleys, onto round cord belts, then onto the lane surface. The round section cord acts as toothless transmission drive belting, but is considerably less expensive, as are round grooved pulleys compared to sprockets. Also unique is a unidirectional centrifugal clutch used in the carriage drive. This clutch only drives the carriage away from the foul line to lay carpet, then frees the wheels when the re-spooling drive motor equipped with similar clutch pulls the carriage back to the foul line. In the approximately 40 seconds it takes to complete re-spooling of the carpet, the carpet is in slight tension causing desired uniform pooling and a compact roll for storage. The separate drive motors, one to propel the carriage, and one for the carpet re-spooling makes reversing drives unnecessary.

Preferably, variable speed electronic motors are used which have a maximum of about 1500 RPM and about a 3 to 1 reduction to a preferred 500 RPM driving sprockets using a roller chain. Remote control allows the person putting to operate the carriage from the bowling approach area.

In accordance with another aspect, the invention provides a remote controlled retriever for ball return. Initially this device is sent down the lane to wait near the carriage for putted balls. When a person finishes putting, the person can use a remote control to command the retriever to return all putted balls back to foul line. In about 40 seconds, the retriever traverses toward the foul line with all the balls lifted into containers, suitably elevated for ease of removal from the retriever. On command, the retriever is sent back down the lane to the wait position, so that more balls can be putted. Motors, clutches, sprockets, roller chain, alley edge guides, round groove pulleys, and round cord belting are similar to those used in the carriage. The unique pick-up of the balls is accomplished by three separate rubber faced wheels attached to a horizontal shaft. Each gutter has one wheel and the third wheel is central to the carpeted lane. Preferably, no part of the retriever touches the carpet. The wheels of the retriever rotate in fixed unison with the round cord drive, so that drive traverse speed equals the wheel peripheral speed. Centrifugal clutch free wheels on the return traverse, so rubber faced wheels do not turn. Balls to be picked up that are resting on the carpet are herded into the central turning wheel by funneling herder bars. Herder arms or bars are also used in gutters prevent any putted ball on carpet or gutter from passing by putting equipment and getting into bowling pit. Rubber parallel faces of pick-up wheels are spaced apart for a distance less than the ball diameter, so as to pinch or wedge the ball in between. Rubber elasticity frictionally captures ball, which then rotates with the wheel until removed by finger near the upper most wheel elevation above carpet or gutter. Fingers have a channel portion to guide ball freed from between rubber faces into an adjoining container. The weight of the retriever rests equally on the four contact points of round cord belting and is carried by bowling gutters, in which it traverses.

The embodiments of the invention, and the invention itself, are now described in such full, clear, concise and exact terms to enable a person of ordinary skill in the art to make and use the invention. To particularly point out and distinctly claim the subject matters regarded as invention, the following claims conclude this specification. To the extent variations from the preferred embodiments fall within the limits of the claims, they are considered to be part of the invention, and claimed.

I claim:

1. An apparatus for practicing golf ball putting comprising a carriage, a carpet wound on a spool, the spool having an axis of rotation and being carried on the carriage, the carpet comprising a carpet putting surface, the carpet putting surface having a longitudinal length longer than its lateral width and comprising a putting location marking and at least one putting target marking, the putting location marking located a predetermined longitudinal distance from the putting target marking, the carpet putting surface facing up when at least a portion of the carpet is laid onto a horizontal surface, drive wheels having a fixed axis of rotation parallel to the axis of rotation of the spool, the drive wheels engaged by a first clutch to move the carriage along a horizontal surface in a first direction and aid in laying at least a portion of the carpet onto the horizontal surface, the spool engaged by a second clutch to move the carriage along a horizontal surface in a second direction opposite the first direction to aid in winding the carpet onto the spool.

2. The apparatus of claim 1, wherein the at least one putting target marking comprises a plurality of substantially "V" shaped markings placed apart from the putting location marking, with each substantially "V" shaped marking having the open end of the "V" closer to the putting location marking than the closed end of the "V."

3. The apparatus of claim 1 wherein the carpet putting surface has a U.S. Golf Association Stimp meter reading of about 10.

4. The apparatus of claim 2, wherein a first substantially "V" shaped marking is located closer to the putting location marking than a second substantially "V" shaped marking.

5. The apparatus of claim 4, wherein each successive substantially "V" shaped marking after the first substantially and second "V" shaped markings are located successively farther from the putting location than the preceding substantially "V" shaped marking.

6. The apparatus of claim 5, wherein each successive substantially "V" shaped marking is spaced a predetermined distance from the putting location marking.

7. A system for practicing golf ball putting comprising the apparatus of claim 1 and a golf ball retriever comprising at least one pair of rotating spaced wheels, each wheel having a pickup surface, the pickup surfaces of the spaced wheels distanced from each other in predetermined amount to pick up a golf ball between the surfaces of the spaced wheels, the pickup surfaces of the spaced wheels adapted to move a golf ball off of the carpet putting surface and move the golf ball to a retriever container as the spaced wheels rotate.

8. The apparatus of claim 7, comprising a motor to drive the rotation of the spaced wheels.

9. The apparatus of claim 1, wherein the carpet putting surface has a width adapted to cover the width of a bowling lane.

10. The apparatus of claim 1, wherein the apparatus is adapted to lay at least a portion of the carpet onto the horizontal surface of a bowling alley lane or to wind the carpet onto the spool from the horizontal surface of a bowling alley lane.

11. The apparatus of claim 1, wherein the carriage is supported by the drive wheels when at least a portion of the carpet is laid onto the horizontal surface or the carpet is being wound onto the spool.

12. The apparatus of claim 10, wherein the carriage is supported by the drive wheels when at least a portion of the carpet is laid onto the horizontal surface or the carpet is being wound onto the spool.

13. The apparatus of claim 11, wherein the the first clutch is driven by a first motor and the second clutch is driven by a second motor.

14. The apparatus of claim 12, wherein the the first clutch is driven by a first motor and the second clutch is driven by a second motor.

15. The apparatus of claim 12, wherein the carriage comprises swivel casters adapted to overhang a bowling alley gutter, the swivel casters adapted for moving the apparatus to or from storage.

16. The apparatus of claim 1, wherein the drive means comprises an electric motor.

17. The system of claim 7, wherein the retriever has an electric motor to drive the retriever along a bowling alley lane and corresponding gutters.

18. The system of claim 7, wherein the retriever comprises two additional pairs of rotating spaced wheels, each wheel having a pickup surface, the pickup surfaces of the spaced wheels distanced from each other in predetermined amount to pick up a golf ball between the surfaces of the spaced wheels, the pickup surfaces of each additional pair of spaced wheels adapted to move a golf ball off of a bowling alley gutter on either side of a corresponding bowling alley lane and move the golf ball to a corresponding retriever container as the spaced wheels rotate.

19. The system of claim 7, wherein the retriever further comprises at least one herding arm to guide golf balls to the at least one pair of rotating spaced wheels.

20. An apparatus for practicing golf ball putting comprising a carriage, and a carpet wound on a spool, the spool having an axis of rotation and being carried on the carriage, the carpet comprising a carpet putting surface, the carpet putting surface having a longitudinal length longer than its lateral width and comprising a putting location marking and at least one putting target marking, the putting location marking located a predetermined longitudinal distance from the putting target marking, the carpet putting surface facing up when at least a portion of the carpet is laid onto a horizontal surface drive wheels having a fixed axis of rotation parallel to the axis of rotation of the spool, wherein the at least one putting target marking comprises a plurality of substantially "V" shaped markings placed apart from the putting location marking, with each substantially "V" shaped marking having the open end of the "V" closer to the putting location marking than the closed end of the "V."

21. The apparatus of claim 20 wherein the carpet putting surface has a U.S. Golf Association Stimp meter reading of about 10.

22. The apparatus of claim 20, wherein a first substantially "V" shaped marking is located closer to the putting location marking than a second substantially "V" shaped marking.

23. The apparatus of claim 22, wherein each successive substantially "V" shaped marking after the first substantially and second "V" shaped markings are located successively farther from the putting location than the preceding substantially "V" shaped marking.

24. The apparatus of claim 23, wherein each successive substantially "V" shaped marking is spaced a predetermined distance from the putting location marking.

* * * * *